US007903030B2

(12) United States Patent
Nagai

(10) Patent No.: US 7,903,030 B2
(45) Date of Patent: Mar. 8, 2011

(54) PLANAR ANTENNA DEVICE AND RADIO COMMUNICATION DEVICE USING THE SAME

(75) Inventor: Shuichi Nagai, Kyoto (JP)

(73) Assignee: Panasonic Corporation, Osaka (JP)

( * ) Notice: Subject to any disclaimer, the term of this patent is extended or adjusted under 35 U.S.C. 154(b) by 409 days.

(21) Appl. No.: 11/916,547

(22) PCT Filed: Apr. 12, 2006

(86) PCT No.: PCT/JP2006/307723
§ 371 (c)(1),
(2), (4) Date: Dec. 5, 2007

(87) PCT Pub. No.: WO2006/132032
PCT Pub. Date: Dec. 14, 2006

(65) Prior Publication Data

US 2009/0256777 A1 Oct. 15, 2009

(30) Foreign Application Priority Data

Jun. 6, 2005 (JP) ..... 2005-166091

(51) Int. Cl.
*H01Q 1/38* (2006.01)

(52) U.S. Cl. ..... 343/700 MS; 343/846

(58) Field of Classification Search ..... 343/700 MS, 343/702, 846, 848
See application file for complete search history.

(56) References Cited

U.S. PATENT DOCUMENTS 4,040,060 A * 8/1977 Kaloi ..... 343/700 MS
4,074,270 A * 2/1978 Kaloi ..... 343/700 MS
4,157,548 A * 6/1979 Kaloi ..... 343/700 MS
4,291,312 A * 9/1981 Kaloi ..... 343/700 MS
4,356,492 A * 10/1982 Kaloi ..... 343/700 MS
6,005,522 A * 12/1999 Arias et al. ..... 343/700 MS
6,466,172 B1 * 10/2002 Ryken et al. ..... 343/700 MS
6,943,651 B2 9/2005 Mukaiyama et al.
2006/0140156 A1 6/2006 Hayashi et al.
2006/0251122 A1 11/2006 Abe et al.

(Continued)

FOREIGN PATENT DOCUMENTS

JP 11-266118 9/1999
JP 2001-203529 7/2001

(Continued)

OTHER PUBLICATIONS

English language Abstract of JP 2004-56498.

(Continued)

*Primary Examiner* — HoangAnh T Le
(74) *Attorney, Agent, or Firm* — Greenblum & Bernstein P.L.C.

(57) ABSTRACT

Provided a practical planar antenna device which has antenna elements facing each other, in which electrical power is fed between the antenna elements. The first feeding point is provided near an end of the first antenna element, which faces the opposite antenna element. The second feeding point is provided near an outer end of the second antenna element, by providing a second slit longer than the distance from the end of the second antenna element to its center. Since the feeding points are provided at the same level, the same electric field is excited in the two antenna elements in phase. The planar antenna device, to which electrical power is fed from the facing sides of the pair of opposite antenna elements, saves a bend conventionally required in a feed line, thereby allowing a wiring area to be smaller than in the conventional method.

6 Claims, 9 Drawing Sheets

U.S. PATENT DOCUMENTS

2007/0183530 A1 8/2007 Udagawa et al.

FOREIGN PATENT DOCUMENTS

| | | |
|---|---|---|
| JP | 2003-309405 | 10/2003 |
| JP | 2004-56498 | 2/2004 |
| JP | 2004-166043 | 6/2004 |
| JP | 2004-200774 | 7/2004 |

OTHER PUBLICATIONS

English language Abstract of JP 2001-203529.
English language Abstract of JP 2003-309405.
English language Abstract of JP 2004-166043.
English language Abstract of JP 11-266118.
English language Abstract of JP 2004-200774.

* cited by examiner

504a:Feeding point
501a:Antenna element
503a: Matching slit
502a:Feed line

501b:Antenna element
504b:Feeding point
503c: Matching slit
503b: Matching slit
502b:Feed line 501c:Antenna element
504c:Feeding point
502c:Feed line 504d:Feeding point
501d:Antenna element
503d:Matching slit
502d:Feed line

PLANAR ANTENNA DEVICE AND RADIO COMMUNICATION DEVICE USING THE SAME

TECHNICAL FIELD

The present invention relates to radio communication devices such as a mobile phone, or devices which measure a distance to a target or recognize the position of a target. The present invention particularly relates to a planar antenna device which transmits and receives radio waves used for the above devices.

BACKGROUND ART

As a conventional planar antenna device, a thin, lightweight microstrip patch antenna is widely available (For example, see Patent Reference 1). The patch antenna has a structure such that a ground conductor (ground) and a rectangular antenna conductor (also known as an "antenna element") to serve as an antenna unit are formed on the back and the face side of a dielectric board, respectively. As electrical power is fed to the antenna conductor, radio waves are radiated at a frequency where resonance occurs according to the length of the longer sides of the antenna conductor. In order to feed electrical power to the antenna conductor, the coplanar feeding system is available in which a feed line provided as a microstrip line (also known as a "feed line") is formed on the surface of the dielectric board, the surface where the antenna conductor is also formed. In this system, which forms the antenna conductor and the feed line on the same surface, a planar antenna device can be manufactured with ease at a low cost.

Typically, the antenna conductor and the feed line are connected at a position called a "feeding point". The design is made such that the impedances of the antenna conductor and the feed line are matched at the feeding point. By matching the impedances so as to prevent reflections from occurring, electrical power can be fed to the antenna conductor with efficiency.

Here, a brief explanation is given as to how to match the impedances of the antenna conductor and the feed line. The impedance of the antenna conductor varies according to its position on the antenna conductor. The impedance is low around the central portion in the antenna, becomes higher toward the end portion, and reaches a value almost equal to infinity at the end. Therefore, a cut (also called as a "matching slit") is made in the antenna conductor down to position of the feeding point, at which the antenna conductor and the feed line are connected, so that the antenna conductor has the same impedance as the feed line. The method thus matches the antenna conductor and the feed line.

In order to use the planar antenna device practically, a predetermined radiation pattern or radiant gain is required. A radiation pattern and a radiant gain characteristic depend on the entire effective aperture dimensions of the antenna conductor. With an antenna conductor of larger dimensions, the antenna's directivity increases and a higher radiant gain is obtained. In the case where the patch antenna is employed singly, since the size of the antenna conductor is determined by the frequency to be used, the radiation directivity decreases and the gain is low. Therefore, in order to adjust a radiation pattern and a radiant gain, the array structure is employed, in which a plurality of antenna conductors are arranged at a specific regular spacing, so as to adjust effective aperture dimensions. However, as the interval between the antenna conductors becomes wider, the side lobe of the radio waves radiated from the array antenna increases in level, the feed line has to be installed into the narrow interval limited by the antenna conductors.

Here, a description is given for the structure of a conventional planar array antenna employing the coplanar feeding system with reference to FIG. 1. FIG. 1 is a top view showing a conventional planar array antenna 1000. The planar array antenna 1000 shown in FIG. 1 includes a dielectric board 1010, four antenna elements 1001, a feed line 1002, and a ground conductor (not shown). Each of the antenna elements 1001 is connected to the power feeder 1005 via the feed line 1002 (in this case, the point where each of the antenna elements 1001 and the feed line 1002 are connected together, is referred to as a "feeding point"). Each of the antenna elements 1001 has a matching slit 1003 for matching the impedances of the antenna elements 1001 and the feed line 1002. The ground conductor is provided at the back of the planar array antenna 1000.

Generally, the array structure shown in FIG. 1, where the antenna elements 1001 are connected to the power feeder 1005 in parallel (tree-shaped structured connection), is available for radiation over a wide range of frequencies.

In the planar array antenna 1000, the antenna elements 1001 have to be excited in phase. This is because the radio waves radiated from the antenna elements 1001 cancel each other thereby degrading their function as an array antenna, in the case where the radio waves from the antenna elements 1001 are out of phase each other.

The planar array antenna 1000, therefore, is designed so that the electrical lengths from the power feeder 1005 to the respective antenna elements 1001, or equivalently, the lengths of the respective sections of the feed line 1002 are equal. Furthermore, in order to excite the electric fields of the respective antenna elements 1001 in a same direction, the respective sections of the feed line 1002, the respective feeding points 1004, and the respective antenna elements 1001 are arranged in a same way. Specifically, the structure is such that the respective sections of the feed line 1002 connect to the respective antenna elements 1001 at the respective feeding points 1004 from a same side.

Patent Reference 1: Japanese Unexamined Patent Application Publication No. 2004-166043

DISCLOSURE OF INVENTION

Problems that Invention is to Solve

As has been described above, in the conventional planar array antenna 1000, since the electric fields of the respective antenna elements 1001 have to be excited in a same direction, the structure is such that all of the feed lines 1002 connect to the respective antenna elements 1001 from a same side. Consequently, a bend 1011 is formed in each of the feed line 1002 as shown in FIG. 1. In the structure having such bends 1011, the feed line 1002 becomes longer, and a larger space is required to lay out the feed line 1002 therein.

Thus, the array antenna which sends and receives high-frequency radio waves is disadvantageous in that losses become larger because of the bends 1011 in the feed lines 1002 and the increased length of the feed line.

Furthermore, in recent years, much attention has been given to a broadband radio communication system called "Ultra-wide Band". In order for the planar antenna to obtain such wideband characteristics, it is effective to employ a thicker antenna board.

In the case where a thicker board is employed, however, the electric fluxes of the feed line 1002 do not terminate in the ground when there is not enough space between the respective feed lines or between the antenna element 1001 and the feed line 1002, thereby causing interference in electromagnetic coupling between the feed lines or between the antenna element and the feed line. Due to such interference, impedance in the feed line 1002 partially changes, thereby causing an unsynchronized phase among the excited field in the antenna elements. Specifically, in the case where the antenna elements 1001 are not excited in phase, the radio waves radiated from the respective antenna elements 1001 cancel each other, thereby extremely worsening their radiation characteristics.

For the reason stated above, in the conventional structure where the feed line occupies a larger portion therein, it is impossible to achieve a planar array antenna with the coplanar feeding system for high-frequency or broadband use.

In order to solve the above problem, the planar array antenna shown in FIG. 2(*a*) is conceivable, having no bend in a feed line, in which antenna elements can be arranged symmetrically.

However, the planar array antenna shown in FIG. 2(*a*) is also impractical. With reference to FIGS. 2(*a*) and (*b*), a reason is given as to the impracticality of a symmetrical array antenna, in which antenna elements are arranged to face each other and electrical power is fed from a feed line located between the facing sides of the antenna elements.

FIG. 2(*a*) is a top view showing the structure of a planar array antenna where a feed line, with a small bend 1011, occupies a smaller portion therein. As shown in FIG. 2(*a*), a planar array antenna 1100 includes a first antenna element 1101*a*, a second antenna element 1101*b*, and a feed line 1102 for feeding electrical power, which are arranged on a dielectric board 1110. Similarly to the matching slit 1003 shown in FIG. 1, the first antenna element 1101*a* and the second antenna element 1101*b* include a first matching slit 1103*a* and a second matching slit 1103*b*, respectively. The structure of the planar array antenna 1100 is such that a branch point 1109 at which the feed line 1002 branches off, is provided at the midpoint between the two antenna elements 1101*a* and 1101*b*, so that electrical power is fed to each of the antenna elements through sections of the feed line 1102 of equal length.

FIG. 2(*b*) is a schematic diagram showing a current distribution 1107 and a voltage distribution 1108 in a cross section of the planar array antenna 1100 taken along the line A-A' of FIG. 2(*a*) in a perpendicular direction. Referring to FIG. 2(*b*), a description is given for the respective states in which the first antenna element 1101*a* and the second antenna element 1101*b* are excited.

FIG. 2(*b*) shows current and voltage distributions with the centers of the first antenna element 1101*a* and the second antenna element 1101*b* arranged symmetrically. As shown in FIG. 2(*b*), the radio waves radiated from the antenna elements partially cancel each other because of their phase difference, which means that it is impossible to obtain a preferable intensity of the radio waves (radiant gain) relative to the vertical plane of the antenna. This is verified by the radiation intensity characteristics shown in FIG. 3.

FIG. 3 shows the intensity of the radio waves radiated in the direction perpendicular to the antenna surface of the planar array antenna 1100 shown in FIG. 2(*a*). In this case, a Teflon (registered trademark) board 0.5 mm thick, with a relative permittivity of 3.0 was employed as the dielectric board 1110 of the planar array antenna 1100. Furthermore, in the planar array antenna 1100, each of the antenna elements was formed into a square, 3.1 mm on a side, with the size of each feed-wire matching slit equivalent to 0.9 mm×0.8 mm (frequency: 26 GHz). The characteristic shown in FIG. 3, where the radiation intensity becomes low in the direction perpendicular to the antenna surface, is insufficient in performance as a planar array antenna. Therefore, the planar array antenna 1100 having the structure shown in FIG. 2(*a*) cannot be employed.

In light of the above, it is an object of the present invention to provide a practical planar antenna device which has antenna elements facing each other, in which electrical power is fed from facing sides of the antenna elements.

Means to Solve the Problems

In order to solve the above described problem, a planar antenna device of the present invention includes at least one antenna pair and a feed line on a dielectric board having a ground conductor on a back surface. The antenna pair includes the first antenna element having the first slit, and the second antenna element having the second slit. The first antenna element and the second antenna element are arranged in the planar antenna device in such a way that the first slit and the second slit are oriented toward a center of the antenna pair. The first antenna element is connected to the feed line electrically or electromagnetically at the first feeding point positioned in an inmost recess of the first slit. The second antenna element is connected to the feed line electrically or electromagnetically at the second feeding point positioned in an inmost recess of the second slit. The first slit of the first antenna element and the second slit of the second antenna element are different in length.

This achieves an array antenna structure where the feed line occupies only a small portion therein without conventional bends, thereby achieving a planar antenna device of the coplanar feeding system, available at a high frequency or on a wide frequency band.

Further, the planar antenna device may be structured such that the distance from the first feeding point of the first antenna element to the branch point is approximately equal to the distance from the second feeding point of the second antenna element to the branch point.

This prevents the radio waves radiated from the antenna elements from canceling each other due to their phase difference, although the planar antenna device has antenna elements facing each other, in which electrical power is fed from facing sides of the antenna elements, thereby achieving a planar array antenna with a desired radiant gain.

Further, the antenna pair may include a plurality of the first antenna elements and a plurality of the antenna elements.

This achieves a planar antenna capable of preventing the radio waves radiated from the antenna elements from cancelling each other due to their phase difference, with space efficiency.

Note that it is preferable that the first antenna element has an area 1 to 1.3 times larger than an area of the second antenna element.

Further, in the planar antenna device, the first slit of the first antenna element is shorter than a length from an end of the first antenna element on a side facing the second antenna element to a center of the first antenna element, and the second slit of the second antenna element is longer than a length from an end of the second antenna element on a side facing the first antenna element to a center of the second antenna element.

Further, the feed line feeds electrical power fed from a power feeder, to the first antenna element and the second antenna element via a branch point, and the first antenna element and the second antenna element are arranged with the branch point in between.

Furthermore, The feed line feeds electrical power fed from a power feeder, to the first antenna element and the second antenna element via a branch point, and the feed line near the branch point is formed into a T-shape, a Y-shape or an arrow-shape.

Further, the planar antenna element of the present invention may be structured so as to include a radiating element conductor having a slit and a feed line on a dielectric board having a ground conductor on a back surface. The radiating element conductor is connected to the feed line electrically or electromagnetically at a feeding point positioned in an inmost recess of the slit. The slit is longer than a length from an end of the radiating element conductor on a side facing the feed line to a center of the radiating element conductor. In this case, the planar antenna element can be miniaturized also as an antenna device.

The present invention can also be achieved as a radio communication device employing the planar antenna device, such as a mobile phone.

EFFECTS OF THE INVENTION

According to the present invention, a bend does not have to be provided in the feed line, thereby achieving an array antenna structure where a smaller portion is occupied by the feed line. There are no losses due to bends, thereby achieving an array antenna with high radiation efficiency. Furthermore, the portion to be occupied by the feed line can become the smallest possible dimensions, thereby achieving a low-loss array antenna with high radiation efficiency, owing to a shorter feed line. Furthermore, the smaller portion to be occupied by the feed line allows the antenna elements to be arranged at a shorter spacing, thereby allowing a grating lobe of the radiated radio waves to be suppressed.

Furthermore, according to the present invention, only a smaller portion is occupied by the feed line, a larger space can be provided between the feed lines, or between the antenna and the feed line, thereby reducing interference between the feed lines. This achieves a broadband antenna which was unavailable due to its thicker antenna board and its larger interference between the feed lines.

BRIEF DESCRIPTION OF DRAWINGS

FIG. 2(*b*) shows current and voltage distributions in the planar array antenna, taken along the line A-A' of FIG. 2(*a*).

FIG. 4(*b*) shows current and voltage distributions taken along the line A-A' of FIG. 4(*a*).

FIG. 9(*b*) shows the appearance of a planar antenna device including two pairs of antenna elements, in each pair of which a first antenna element and a second antenna element are arranged to face each other as well as to orient a same direction.

FIG. 10(*b*) shows an exemplary antenna element according to the present invention, in which a matching slit is provided in a slanting direction; FIG. 10(*c*) shows an exemplary antenna element according to the present invention, in which a circular antenna element is employed; FIG. 10(*d*) shows an exemplary antenna element according to the present invention, in which a feed line and an antenna element are connected electromagnetically; FIG. 10(*e*) shows an example according to the present invention in which a feed line is formed into Y-shape near a branch point; and FIG. 10(*f*) shows an example according to the present invention in which a feed line is formed like an arrow near a branch point.

NUMERICAL REFERENCES

Figure 1:
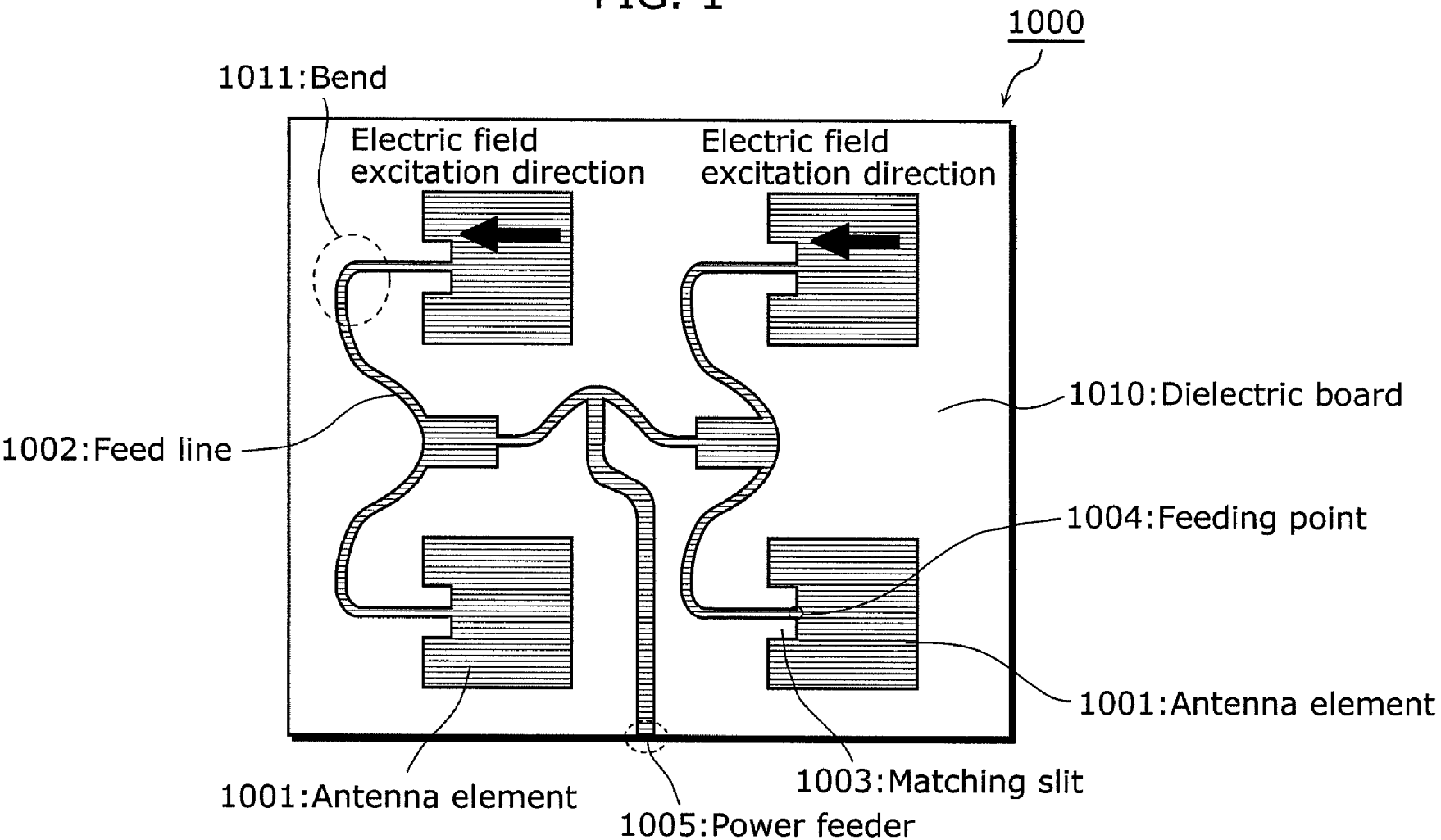
FIG. 1 is a top view showing a conventional planar antenna device having a 2×2 array structure.
Figures 2A, 2B:
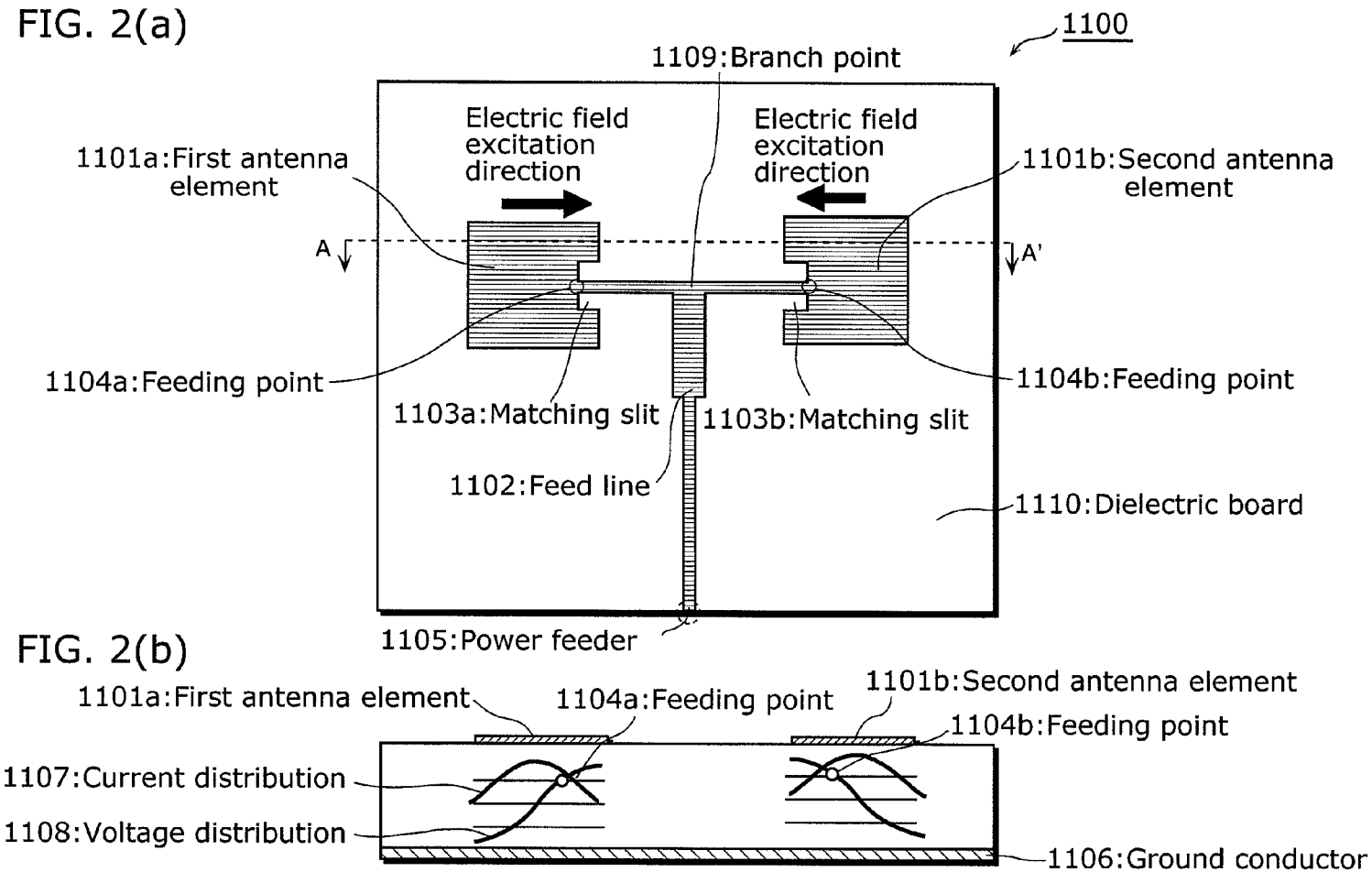
FIG. 2(*a*) is a top view showing another conventional planar array antenna.
Figure 3:
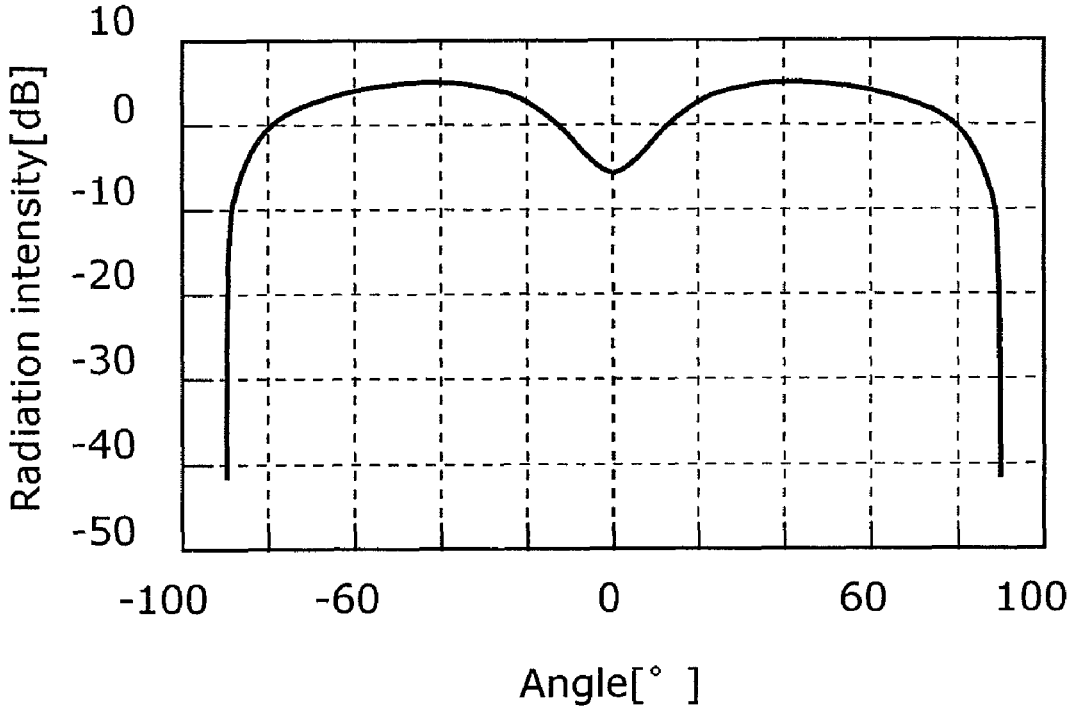
FIG. 3 shows a radiation characteristic of the conventional planar array antenna.

10, 11, 12 Planar antenna device
101*a*, 301*a*, 1101*a* First antenna element
101*b*, 301*b*, 1101*b* Second antenna element
102, 302, 1002, 1102 Feed line
103*a*, 1103*a* First slit
103*b*, 1103*b* Second slit
1003, 1103*a*, 1103*b* Matching slit
104*a*, 304*a* First feeding point
104*b*, 304*b* Second feeding point
105, 305, 1005, 1105 Power feeder
106, 406, 1006 Ground conductor
107, 1007 Current distribution
108, 1008 Voltage distribution
109, 1009 Branch point
110, 310, 410, 1010, 1110 Dielectric board
401 Antenna conductor
501*a*, 501*b*, 501*c* Antenna element
501*d* Antenna element
502*a*, 502*b*, 502*c* Feed line
502*d* Feed line
503*a*, 503*b*, 503*c* Matching slit
503*d* Matching slit
504*a*, 504*b*, 504*c* Feeding point
504*d* Feeding point
1004, 1104*a*, 1104*b* Feeding point
1000, 1100 Planar array antenna
1011 Bend

BEST MODE FOR CARRYING OUT THE INVENTION

Hereinafter, a planar antenna device according to the embodiment of the present invention is described with reference to accompanying drawings. Although the description is given for the present invention with the following embodiment and the accompanying drawings, the embodiment and the drawings are given for exemplification; the present invention is not limited to the embodiment and the drawings.

Figures 4A, 4B:
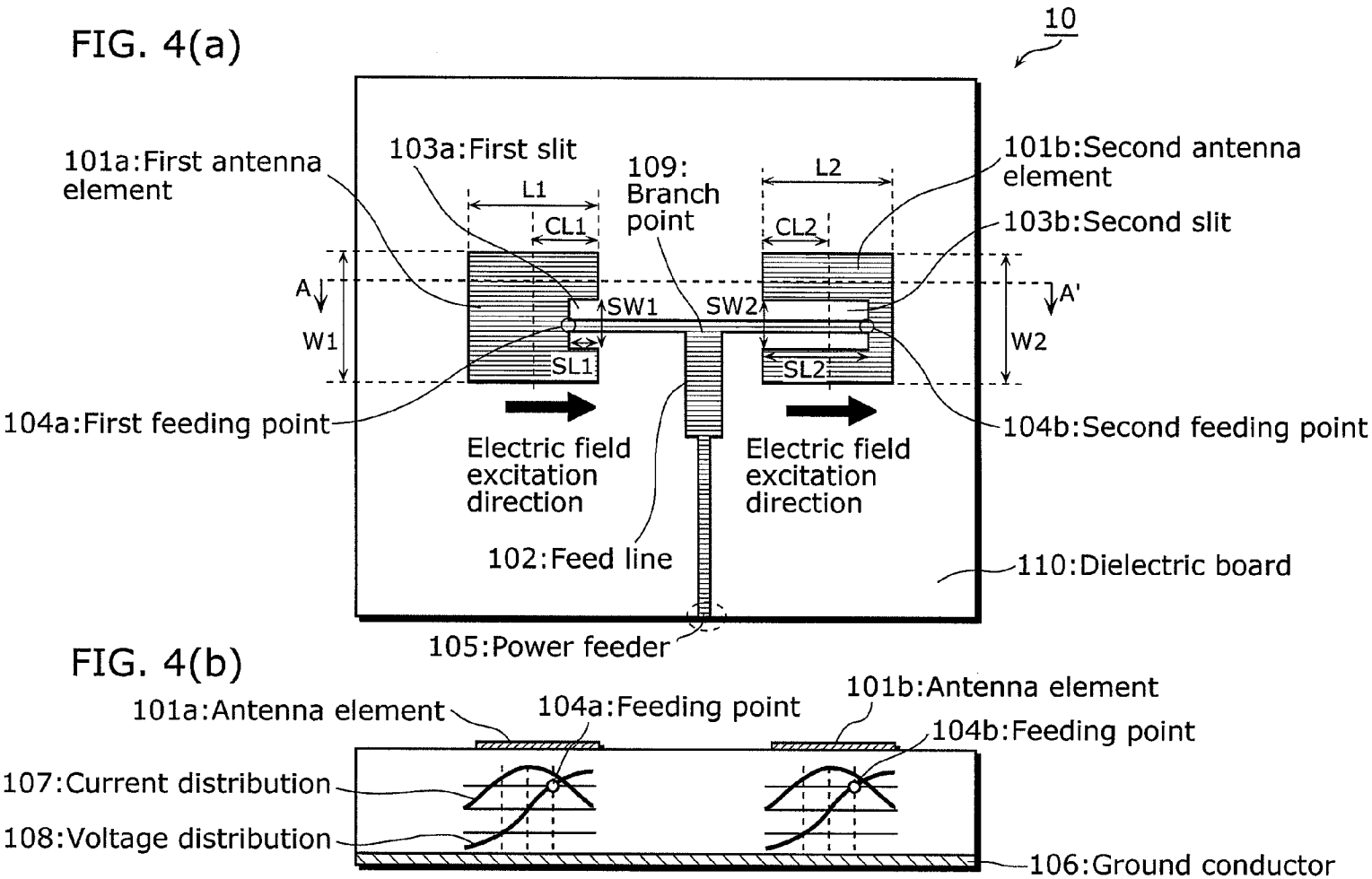
FIG. 4(*a*) is a top view showing a planar antenna device according to the present invention.

FIG. 4(*a*) is a top view showing a planar antenna device 10 according to the present invention. The planar antenna device 10 shown in FIG. 4(*a*) includes a first antenna element 101*a*, a second antenna element 101*b*, a first feeding point 104*a*, a second feeding point 104*b*, impedance-matching first slit

103*a* and second slit 103*b*, a feed line 102 (a branch point 109 included), a power feeder 105 and a dielectric board 110.

The first feeding point 104*a* of the first antenna element 101*a* is provided on the side of the first antenna element having an edge facing the branch point 109 of the feed line 102 (specifically, right-sided end of the first antenna element 101*a*). On the other hand, the second feeding point 104*b* of the second antenna element 101*b* is provided near the right-sided end of the second antenna element 101*b*, the end which is in the inmost position of recess of the second slit 103*b*.

Specifically, the length of the first slit 103*a* "SL1" is shorter than the distance from the right-sided end of the first antenna element 101*a* to its center (specifically, L1/2). The length of the second slit 103*b* "SL2" is longer than the distance from the left-sided end of the second antenna element 101*b* to its center (specifically, L2/2).

Even in such a structure, each of the impedances of the first antenna element 101*a* and the second antenna element 101*b*, which is symmetrical relative to the center of each antenna element, can be matched to the impedance of the feed line 102 either at the first feeding point 104*a* or at the second feeding point 104*b*.

In this case, the feed line 102 has the same line width both for connecting to the first antenna element 101*a* and for connecting to the second antenna element 101*b*. The sections of the feed line from the branch point 109 both to the first feeding point 104*a* and to the second feeding point 104*b*, have almost the same length. This means that electrical power is fed to the first antenna element 101*a* and to the second antenna element 101*b* in phase. Furthermore, the first feeding point 104*a* and the second feeding point 104*b* are provided on the same side (in this case, on the right side) within each antenna element, which means that their electric fields are excited in the same way. Therefore, the radio waves radiated from the first antenna element 101*a* and the second antenna element 101*b* intensify each other.

Referring to FIG. 4(*b*), a more detailed description is given for the phase relation between the electric fields excited by the respective antenna elements. FIG. 4(*b*) shows a current distribution 107 and a voltage distribution 108 in each of the antenna element 101*a* and the antenna element 101*b*, taken along the line A-A' of the planar antenna device 10 shown in FIG. 4(*a*). As shown in FIG. 4(*b*), the planar antenna device 10 has the first antenna element 101*a*, the second antenna element 101*b*, the first feeding point 104*a*, the second feeding point 104*b*, and the like, arranged on the surface of the dielectric board 110. A ground conductor 106 is provided at the back of the dielectric board 110.

Since the second feeding point 104*b* of the second antenna element 101*b* is provided on the right side similarly to the feeding point 104*a* of the first antenna element 101*a*, the electric field in the second antenna element 101*b* is excited in the same direction as in the first antenna element 101*a*. Specifically, the electric fields in the first antenna element 101*a* and the second antenna element 101*b* are excited exactly the same as in the case when electrical power is fed from the same side. Therefore, similarly to the conventional technology shown in FIG. 1, although the feed line sections from the branch point 109 have almost the same length, the radio waves radiated from the respective antenna elements intensify each other.

Hereinafter, a specific example is given for the planar antenna device 10 according to the present invention.

As the dielectric board 110 of the planar antenna device 10 having the array structure shown in FIG. 4(*a*), a Teflon (registered trademark) board of 0.5 mm thick, with a relative permittivity of 3.0 was employed. The first antenna element 101*a* is formed into a square having 3.1 mm on a side, (specifically "W1=L1"). The second antenna element 101*b* has the width "W2" of 3.1 mm and the length "L2" of 2.8 mm. The first slit 103*a* has the width "SW1" of 0.8 mm and the length "SL1" of 0.9 mm. The second slit 103*b* has the width "SW2" of 0.5 mm and the length "SL2" of 2.4 mm. The feed line 102 has a width of 0.2 mm. Note that the first antenna element 101*a* preferably has dimensions 1 to 1.3 times larger than the dimensions of the second antenna element 101*b*.

Figure 5:
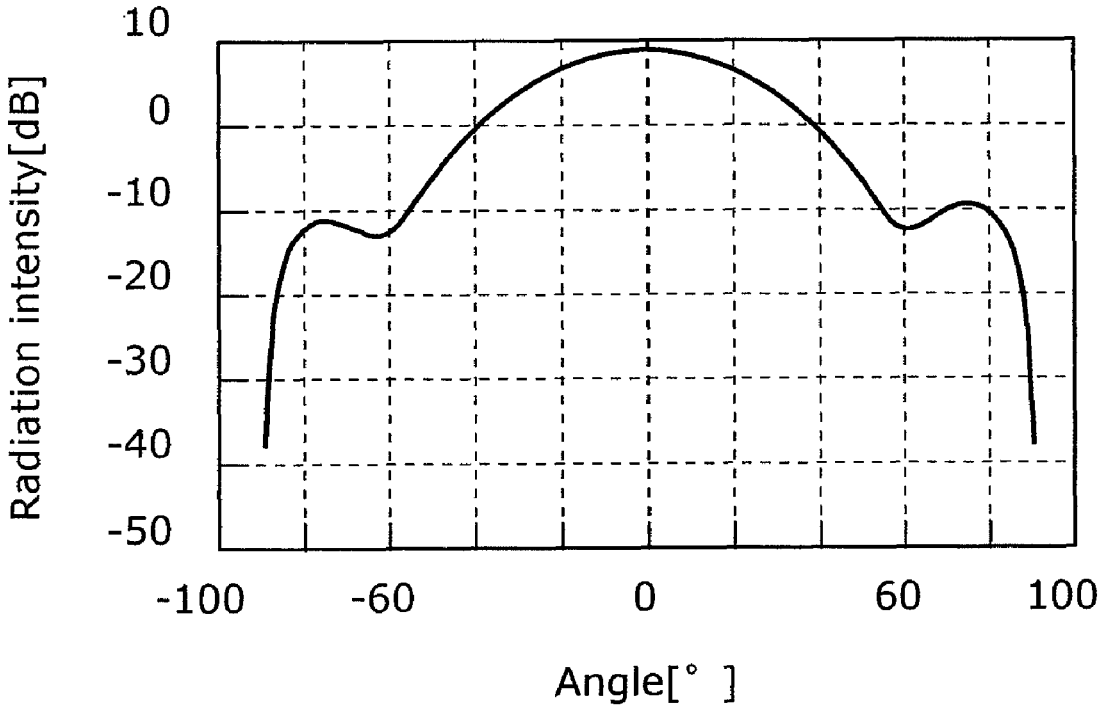
FIG. 5 shows a radiation characteristic of the radio waves radiated from the planar antenna device shown in FIG. 4(*a*).

FIG. 5 shows the intensity of the radio waves radiated at a frequency of 26 [GHz] from the planar antenna device 10 shown in FIG. 4(*a*). The angle given along the horizontal axis means the angle from the axis perpendicular to the antenna surface.

As shown in FIG. 5, since the electric fields in the first antenna element 101*a* and the second antenna element 101*b* are excited in phase in the same direction, the radiation intensity reaches a maximum value in the axis direction perpendicular to the antenna surface.

Figure 6:
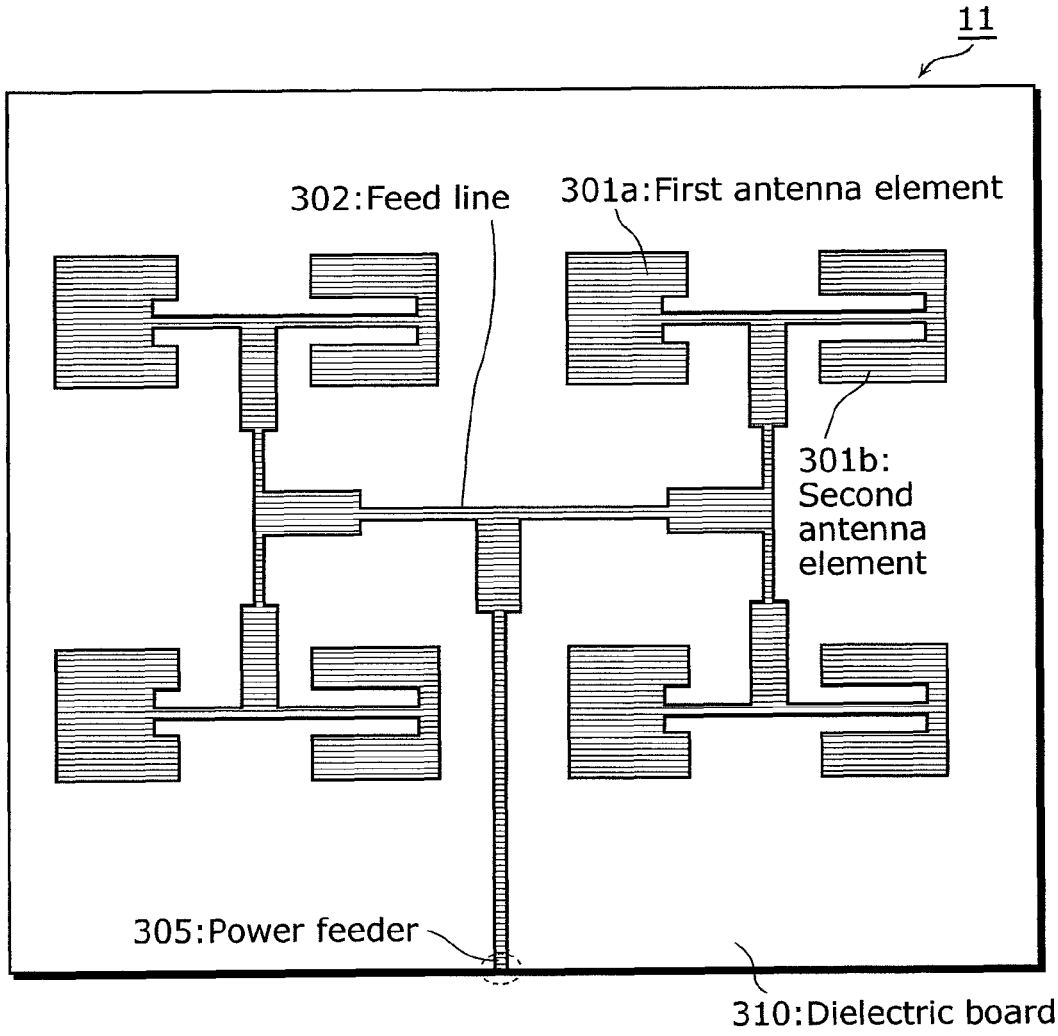
FIG. 6 is a top view showing a 2×4 array antenna according to the present invention.

As has been described above, according to the planar antenna device of the present invention, even in the system where at least two antenna elements are arranged so that their matching slits face each other and electrical power is fed from facing sides of antenna elements, it is possible to excite the electric fields in the antenna elements in phase in the same direction. Furthermore, it is naturally possible to achieve a large-scale planar array antenna such as the 2×4 array structure shown in FIG. 6, by employing a plurality of the planar antenna devices according to the present invention.

Figure 7:
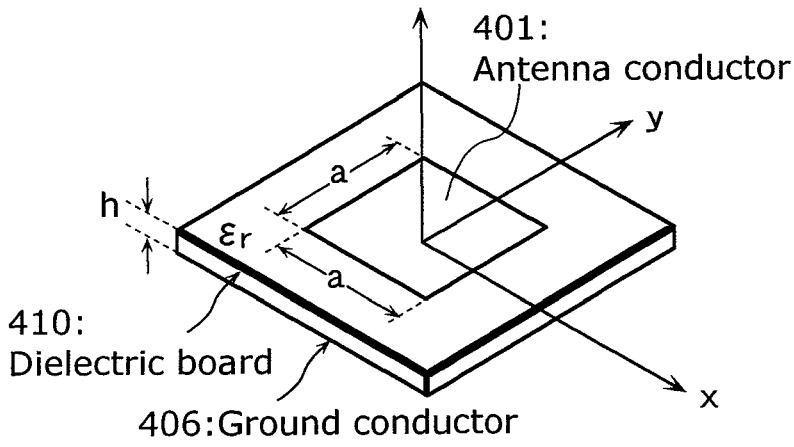
FIG. 7 shows the appearance of a typical planar patch antenna.

Next, a description is given for a single antenna element of the planar antenna device 10 according to the present invention. FIG. 7 shows the appearance of a typical planar patch antenna. The planar patch antenna shown in FIG. 7 has an antenna conductor formed into a square having the length of "a" on a side, on the surface of the dielectric board 410. The planar patch antenna has a ground conductor 406 at the back thereof. In this case, the resonance frequency fr is given by Equation (1).

[Expression 1]

$$fr = \frac{c}{2 \cdot a_{eff} \cdot \sqrt{\varepsilon r}} \tag{1}$$

$$\begin{cases} a_{eff} = a\left\{1 + 0.824 \cdot \frac{h}{a} \cdot \frac{(\varepsilon e + 0.3) \cdot (a/h + 0.262)}{(\varepsilon e + 0.258) \cdot (a/h + 0.813)}\right\} \\ \varepsilon e = \frac{\varepsilon r + 1}{2} + \frac{\varepsilon r - 1}{2}\left(1 + 10\frac{h}{a}\right)^{-\frac{1}{2}} \end{cases}$$

In this case, the Qt value of the antenna is given by Equation (2) (for further explanation of Equations (1) and (2), see "SAISHIN HEIMEN ANTENA GIJYUTU" by Misao HANEISHI (1993)).

$$1/Qt = 1/Qr + 1/Qc + 1/Qd \tag{2}$$

Qr: radiation loss; Qc: conductive loss; Qd: dielectric loss

As has been described above, the first antenna element 101*a* of the planar antenna device 10 shown in FIG. 4 has a structure such that the first feeding point 104*a* is provided between the end of the first antenna element 101*a* on the side facing the feed line 102, and the center of the antenna element 101*a*. This structure is employed as the conventional offset feeding technique.

On the other hand, the second antenna element 101*b* shown in FIG. 4 has a structure such that the feeding point 104*b* is provided between the right-sided end of the second antenna element 101*b*, on the opposite side of the feed line 102, and the center of the antenna element 101*b* (specifically, SL1<SL2). As has been described above, the impedances of the first antenna element 101*a* and the second antenna element 101*b* are symmetrical relative to their centers, thereby achieving a practical antenna.

Figure 8:
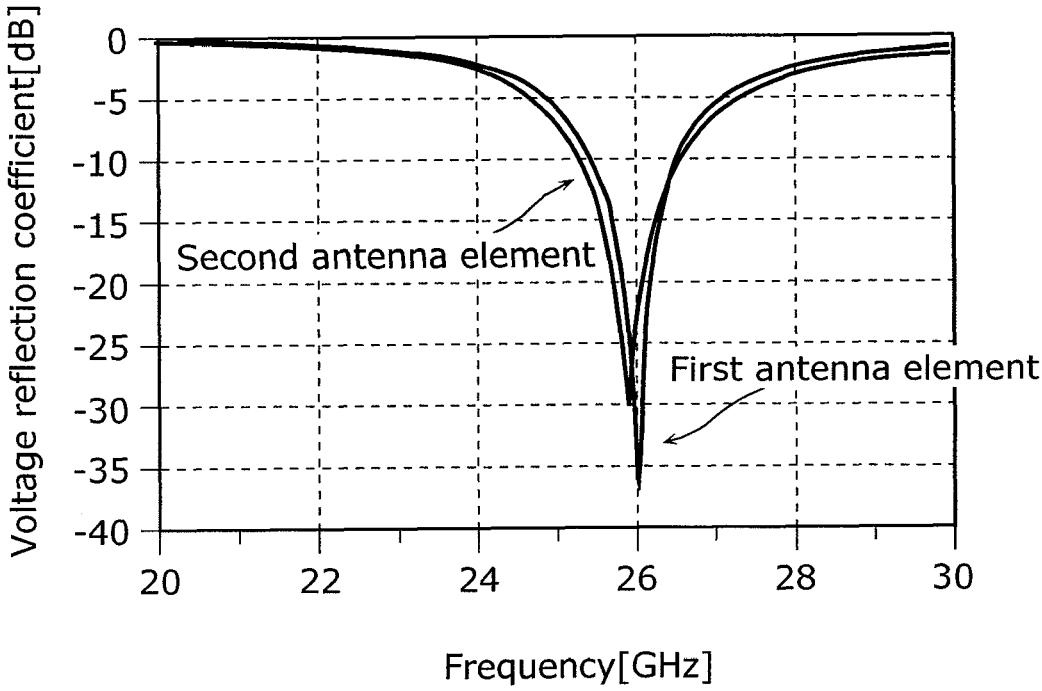
FIG. 8 shows frequency characteristics of the voltage reflection coefficients of first and second antenna elements according to the present invention on an individual basis.

FIG. 8 shows frequency characteristics of the voltage reflection coefficients of the first antenna element 101*a* and the second antenna element 101*b* on an individual basis. The second antenna element 101 has a matching slit of a shape different from the matching slit of the first antenna element 101*a* equivalent to the conventional antenna element. However, FIG. 8 verifies that the second antenna element 101*b* shows a frequency characteristic equivalent to the first antenna element 101*a*. Furthermore, it becomes possible to make the length "L2" of the second antenna element 101*b* shorter than the first antenna element 101*a* equivalent to the conventional antenna element.

Although the embodiment relates to the case in which the electrical lengths and the feed line lengths are the same from the branch point to the respective feeding points, these lengths may vary.

Furthermore, the embodiment relates to the example in which the widths of the respective feed lines, as well as their impedances, are equal to each other. However, the widths and the impedances may be different from each other.

Furthermore, although the embodiment relates to linear polarization, circular polarization may also be employed.

Furthermore, although the embodiment relates to the case in which the antenna elements operate at the same central operating frequency, the antenna elements may operate at different central operating frequencies.

Furthermore, the embodiment relates to the case in which two patch antennas are employed, the present invention is achieved also as two array antennas or more.

Furthermore, the embodiment has described the antenna device which has a single pair of the first antenna element 101*a* and the second antenna element 101*b*, with the branch point 1109 in between as shown in FIG. 1. However, the antenna device is also available, having a plurality of pairs of antenna elements, in which first antenna elements 101*a* and second antenna elements 101*b* of the same number are arranged with a branch point 1109 in between.

Figure 9A:
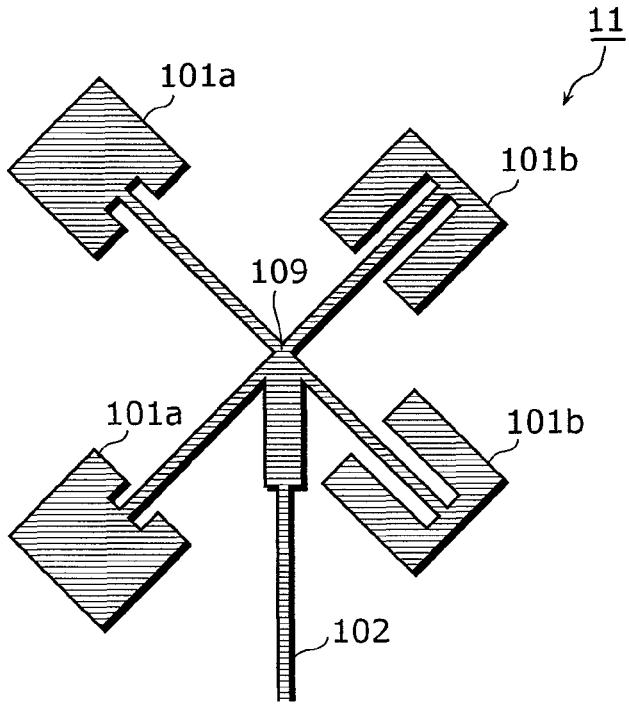
FIG. 9(*a*) shows the appearance of a planar antenna device including two pairs of antenna elements, in each pair of which a first antenna element and a second antenna element are arranged to face each other.
Figure 9B:
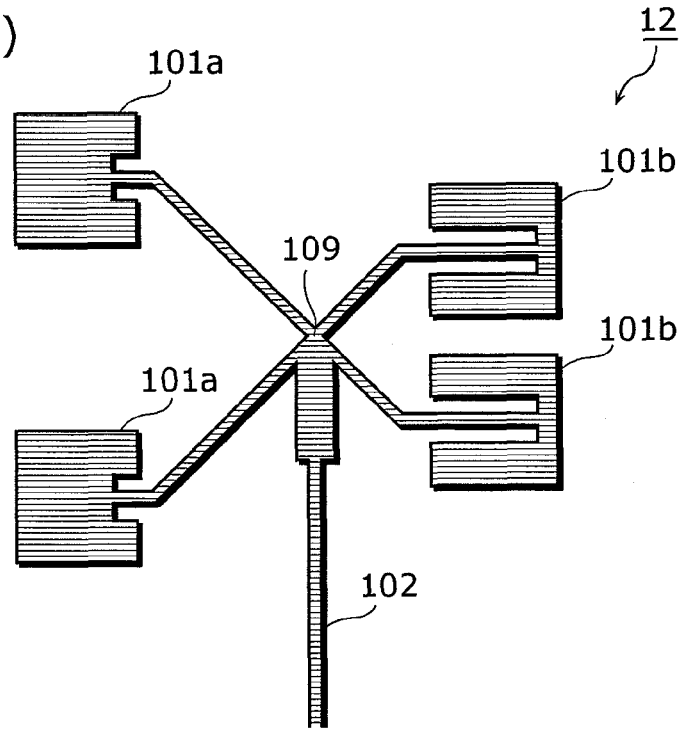

FIGS. 9(*a*) and 9(*b*) show an exemplary planar antenna device including a plurality pairs of antenna elements, in which first antenna elements 101*a* and second antenna elements 101*b* are provided. FIG. 9(*a*) shows the appearance of a planar antenna device 11 including two pairs of antenna elements, in each pair of which a first antenna elements 101*a* and a second antenna element 101*b* are arranged to face each other. Furthermore, FIG. 9(*b*) shows the appearance of a planar antenna device 12 including two pairs of antenna elements, in each pair of which a first antenna element 101*a* and a second antenna element 101*b* are arranged to face each other as well as to orient a same direction. Both the planar antenna device 11 and the planar antenna device 12 have a structure such that the distances from the branch point to the respective feeding points are almost equal.

Figures 10A, 10B, 10C, 10D, 10E, 10F:
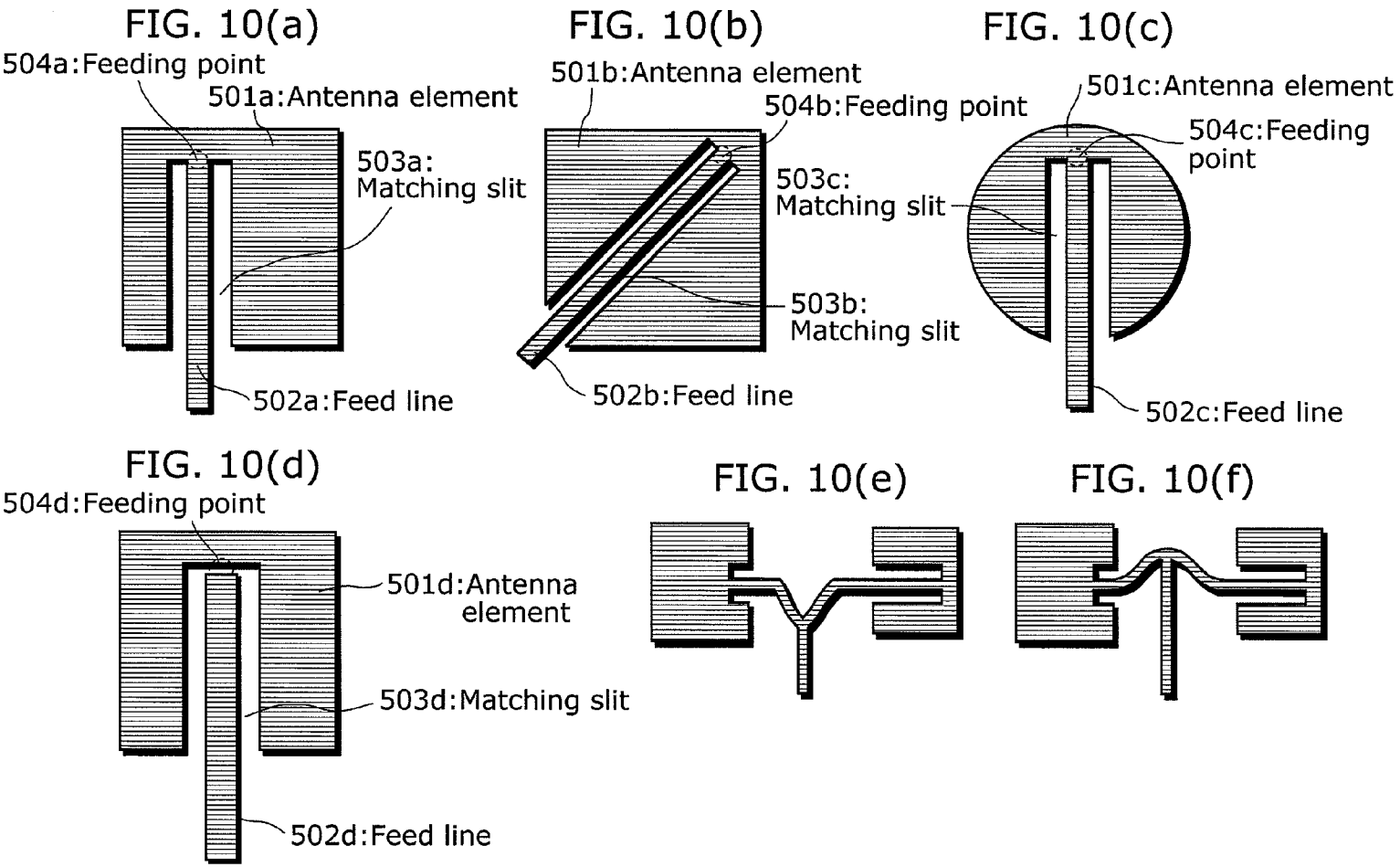
FIG. 10(*a*) shows an exemplary antenna element according to the present invention, in which a matching slit is arranged off-center.

Furthermore, although the embodiment relates to the example in which the wires are connected to the end's center point of each antenna element, the wires may be connected at a position deviated from the center point as shown in FIG. 10(*a*).

Furthermore, although the embodiment relates to the T-shaped structure in which the feed lines are connected or electrical power is fed perpendicularly to a side of the patch antenna, the structure may be such that the feed lines are connected or electrical power is fed at a given angle from the antenna side. For example, the structure may be formed into Y-shape as shown in FIG. 10(*e*), or formed like an arrow as shown in FIG. 10(*f*).

Furthermore, although the embodiment relates to the rectangular planar patch antenna, various shapes of planar antennas such as a circular planar antenna shown in FIG. 10(*c*) and an antenna having a matching slit formed therein, are also applicable. For example, although not shown, a planar antenna of a polygonal shape may be employed, including a pentagon, hexagon, and an icosagon. Quadrilaterals other than a rectangle are also applicable. Examples of quadrilaterals other than a rectangle include a rhombus and a parallelogram.

Furthermore, although the embodiment relates to the case in which the feed line is connected in the direction perpendicular to the parallel ends of the planar patch antenna, the feed line may be connected at an angle other than perpendicular as shown in FIG. 10(*b*).

Furthermore, as shown in FIGS. 10(*a*) to 10(*d*), the antenna element is electrically or electromagnetically connected to the feed line at the feeding point positioned in the inmost position of the recess of the slit. The matching slit is longer than the length from the end of the radiating element conductor on the feed line side to the center of the radiating element conductor, so that the antenna element can be downsized, thereby miniaturizing the whole antenna device. Note that the antenna element 101*a* shown in FIG. 4(*a*) may be connected to the feed line 102 electromagnetically at the first feeding point 104*a* in the inmost position of the recess of the first slit 103*a*.

Although linear in the embodiment, the feed line does not have to be linear. The embodiment relates to the case in which the feed line is connected to the antenna element through wiring, the feed line and the antenna element may be connected electromagnetically as shown in FIG. 10(*d*).

Furthermore, the embodiment of the present invention relates to the case in which the matching slit has a rectangular structure, the structure may be formed into other shapes.

INDUSTRIAL APPLICABILITY

According to the antenna device of the present invention, matching slits of a antenna element pair are provided asymmetrically so that the positions of feeding points are on the same side of the antenna device. This allows the wiring portion to be the smallest possible dimensions, thereby improving the antenna characteristics. The antenna device of the present invention is extremely effective as an antenna device for high-frequency and broadband.

The invention claimed is:

1. A planar antenna device, comprising:

at least one antenna pair and a feed line on a dielectric board having a ground conductor on a back surface, said antenna pair including a first antenna element having a first slit, and a second antenna element having a second slit, wherein said first antenna element and said second antenna element are arranged in said planar antenna device in such a way that said first slit and said second slit are oriented toward a center of said antenna pair, said first antenna element being connected to said feed line electrically or electromagnetically at a first feeding point positioned in an inmost recess of said first slit, said second antenna element being connected to said feed line electrically or electromagnetically at a second feeding point positioned in an inmost recess of said second slit, and said first slit of said first antenna element and said second slit of said second antenna element are different in length, wherein said first slit of said first antenna element is shorter than a length from an end of said first antenna element on a side facing said second antenna to a center of said first antenna element, and said second slit of said second antenna element is longer than a length from an end of said second antenna element on a side facing said first antenna element to a center of said second antenna element, wherein said feed line feeds electrical power fed from a power feeder, to said first antenna element and said second antenna element via a branch point, and a distance from said first feeding point of said first antenna element to said branch point is approximately equal to a distance from said second feeding point of said second antenna element to said branch point, and wherein said first antenna element and said second antenna element operate at substantially the same central operating frequency.

2. The planar antenna device according to claim 1, wherein said at least one antenna pair includes a plurality of said first antenna elements and a plurality of said second antenna elements.

3. The planar antenna device according to claim 1, wherein said first antenna element has an area substantially the same as an area of said second antenna element.

4. The planar antenna device according to claim 1, wherein said first antenna element and said second antenna element are arranged with said branch point in between.

5. The planar antenna device according to claim 1, wherein said feed line near said branch point is formed into a T-shape, a Y-shape or an arrow-shape.

6. A radio communication device, comprising:

a planar antenna device which includes at least one antenna pair and a feed line on a dielectric board having a ground conductor on a back surface, said antenna pair having a first antenna element with a first slit, and a second antenna element with a second slit, wherein said first antenna element and said second antenna element are arranged in said planar antenna device in such a way that said first slit and said second slit are oriented toward a center of said antenna pair, said first antenna element being connected to said feed line electrically or electromagnetically at a first feeding point positioned in an inmost recess of said first slit, said second antenna element being connected to said feed line electrically or electromagnetically at a second feeding point positioned in an inmost recess of said second slit, and said first slit of said first antenna element and said second slit of said second antenna element are different in length, wherein said first slit of said first antenna element is shorter than a length from an end of said first antenna element on a side facing said second antenna to a center of said first antenna element, and said second slit of said second antenna element is longer than a length from an end of said second antenna element on a side facing said first antenna element to a center of said second antenna element, wherein said feed line feeds electrical power fed from a power feeder, to said first antenna element and said second antenna element via a branch point, and a distance from said first feeding point of said first antenna element to said branch point is approximately equal to a distance from said second feeding point of said second antenna element to said branch point, and wherein said first antenna element and said second antenna element operate at substantially the same central operating frequency.

* * * * *